United States Patent [19]

Dugge

[11] Patent Number: 5,000,358

[45] Date of Patent: Mar. 19, 1991

[54] LOW PROFILE PNEUMATIC OUTLET

[75] Inventor: Richard H. Dugge, Des Peres, Mo.

[73] Assignee: ACF Industries, Incorporated, Earth City, Mo.

[21] Appl. No.: 364,110

[22] Filed: Jun. 12, 1989

[51] Int. Cl.[5] ..... B65D 47/00

[52] U.S. Cl. ..... 222/502; 222/506; 222/559; 105/251; 105/253; 105/255; 105/282.1; 105/289; 105/296; 298/27; 406/130; 414/378; 414/414

[58] Field of Search ..... 222/481–483, 222/484, 485, 486, 487, 502, 503, 505, 506, 559–563; 105/250, 251, 253, 254, 255, 280, 282.1, 286–288, 289, 296, 308.1, 309, 310; 414/328, 329, 332, 378, 414; 406/128, 130; 298/27

[56] References Cited

U.S. PATENT DOCUMENTS

| | | | |
|---|---|---|---|
| 3,048,448 | 8/1962 | Aller | 302/52 |
| 3,397,654 | 8/1968 | Snyder | 222/505 X |
| 3,482,741 | 12/1969 | Fritz | 222/554 |
| 3,501,030 | 3/1970 | Flink | 105/296 X |
| 3,693,846 | 9/1972 | Schuller et al. | 222/506 |
| 3,700,143 | 10/1972 | Shaver et al. | 222/148 |
| 3,701,460 | 10/1972 | Dugge et al. | 222/193 |
| 3,778,114 | 12/1973 | Carney et al. | 302/52 |
| 3,876,261 | 4/1975 | Jucius et al. | 302/52 |
| 3,980,212 | 9/1976 | Aller et al. | 222/485 |
| 4,082,365 | 4/1978 | Dugge et al. | 222/505 X |
| 4,151,935 | 5/1979 | Dugge | 222/556 |
| 4,248,552 | 2/1981 | Dugge | 406/129 |
| 4,388,026 | 6/1983 | Green | 222/505 X |
| 4,411,560 | 10/1983 | McComb | 406/128 |
| 4,695,207 | 9/1987 | Miller et al. | 406/130 |

FOREIGN PATENT DOCUMENTS

| | | | |
|---|---|---|---|
| 972624 | 8/1975 | Canada | 105/282.2 |

*Primary Examiner*—David H. Bollinger

*Attorney, Agent, or Firm*—Polster, Polster and Lucchesi

[57] ABSTRACT

A low profile pneumatic outlet for a covered hopper railway car is disclosed which allows the bottom slope sheets of the hopper car to be moved downwardly closer to the rail thereby increasing the cubic capacity of the car while maintaining the car within AAR clearances. The low profile aspects of the pneumatic outlet result from the provision of an outlet opening in the bottom of the outlet which is opened and closed by a slidable, translatable gate operated by gate opening and closing cam mechanisms positioned generally horizontally with respect to the gate. The preferred gate operating mechanism is a cam operated mechanism which generates a high mechanical advantage initially upon effecting opening movement of the gate thereby to overcome lading and static friction loads, and then, after movement of the gate has been initiated, a lower mechanical advantage is provided so as to more rapidly move the gate toward its open position. An outlet cap is provided at each end of the outlet and each cap includes a probe which is located between the inner ends of the gate when the gate is in its closed position thereby positively preventing opening of the gate with one or both of the caps in place.

20 Claims, 7 Drawing Sheets

LOW PROFILE PNEUMATIC OUTLET

BACKGROUND OF THE INVENTION

This invention relates to a low profile pneumatic outlet for a covered hopper railway car or the like.

Typically, covered hopper cars are provided with pneumatic outlets to efficiently unload powdered, granular, or other pulverulent ladings from below in an expeditious and labor efficient manner. Hundreds, if not thousands, of pulverulent ladings have been transported by covered hopper cars and pneumatically unloaded utilizing prior art pneumatic outlet gates. In many service applications, such as in the transport of low density plastic pellets or other commodities, the limiting factor on the amount of lading a car can carry is determined by the volumetric capacity of the car rather than the weight of the lading. The Association of American Railroads (AAR) limits the total weight of a loaded rail car to 263,000 pounds. Typically, covered hopper rail cars of relatively large capacity weigh 60,000–65,000 when empty. This implies a maximum weight of lading carried on these cars of between 198,000–203,000 pounds. Since the weight of conventional covered hopper cars, when loaded, often are not up to the maximum AAR weight limit, it is beneficial to shippers to have a larger volume car such that more lading can be shipped on each trip of the car.

However, the AAR has also established a clearance diagram so rail cars can travel the rails safely without interference from trackside obstructions, bridges, tunnels or the like. Generally, these clearance diagrams limit the maximum width of the car to 10',8". The plate "C" AAR diagram, which is conventionally used for covered hopper railway car service, limits the maximum height of the car to 15'6" above the top of the rails. Also, the lowermost portion of the car body must be 2.75" above the top of the rails. All car appurtenances, such as walks, ladders, valves, railings, pneumatic outlets and the like must be kept within the boundaries of the clearance diagram.

The AAR has also defined a so-called base car and regulations which state, inter alia, that if the distance between the truck centers (i.e., the distance between the centers of the car trucks or wheel and axle assemblies) on a car are increased, the car must be made narrower to stay within the clearance diagram. For example, the base car defined by the AAR has a maximum width of 10'8" with the distance between truck centers being 41'3". If the distance between truck centers is increased to 75', the maximum width of the car must be decreased from 10'8" to 8'5". Thus, in designing covered hopper cars for a maximum lading carrying capability of low bulk density pulverulent materials, increased volume cannot be achieved merely by increasing the length of the car.

As previously noted, pneumatic outlets have long been used for unloading pulverulent materials from covered hopper cars. Reference is made to the co-assigned U.S. Pat. Nos. 3,701,460, 3,778,114, 4,114,785, 4,151,935, which disclose various pneumatic outlets in wide spread service which are commercially available from the assignee of this invention, ACF Industries, Incorporated, and which are identified by the ACF trade designations as 5131 and 5135 pneumatic outlets. Reference is also made to U.S. Pat. Nos. 3,048,448, 3,482,741, 3,876,261, 3,980,212, and 4,411,560 which disclose other pneumatic outlets.

All of these above-described prior art outlets may be characterized in that they are intended to be bolted to the bottom slope sheets of a railway hopper car and to have an elongate opening extending generally transversely of the car with the opening selectively opened or blocked by a valve. When the valve or gate is open, the pulverulent material within the railway car is free to fall downwardly into a generally transversely extending tube or air passage. This air passage is connected to an air conveying system which moves air rapidly through the tube so as to entrain the pulverulent material and to air convey the pulverulent material from the car.

Generally, the above identified prior art outlets utilize a rotary valve to control flow of pulverulent material into the air conveying tube located below the outlet.

Reference is further be made to U.S. Pat. Nos. 3,693,839, 3,693,846, 3,700,143, 4,388,026 and 4,695,207. These prior art patents disclose pneumatic outlets in which a single outlet gate is translationally (i.e., moved in horizontal direction without rotation) by means of a rack and pinion actuator or, in the case of the above-noted U.S. Pat. No. 4,695,207, by means of a crank mechanism.

While, generally, all of the above noted pneumatic outlets worked well for their intended purposes the prior art outlets were, relative to the present invention, tall from the bottom of their outlet tubes to the plane at which they were attached to the bottom of the hopper slope sheets. Since, in accordance with AAR regulations, the bottom of the outlet tube must be a prescribed height above the top of the rails, this defined the height of the bottom edges of the hopper slope sheets.

It is also necessary to provide a particular angle for the bottom slope sheets of the hoppers leading downwardly to the pneumatic outlets so to ensure that pulverulent material can be effectively unloaded by the pneumatic outlets. Thus, the height of the outlet and the required angle for the bottom slope sheets for the hopper and for the outlet pan defines the shape of the lower structure of the hopper car. This, in turn, defines the volume of the lower portion of the car.

SUMMARY OF THE INVENTION

Among the several objects and features of the present invention may be noted the provision of a low profile pneumatic outlet which is of considerably lower height (e.g., about 5") as compared to prior art outlets and which thereby allows the lower slope sheets of the hoppers of a covered hopper car to move downwardly, thereby increasing the volumetric capacity of the covered hopper car while maintaining proper unloading characteristics and without a substantial increase in materials, cost, weight, or labor in fabricating the railcar.

The provision of such a low profile outlet which has two spaced apart outlet openings each controlled by independently operable outlet gates.

The provision of such a low profile pneumatic outlet in which each of the gates is moved horizontally between an open and a closed position by means of a cam actuator in such manner that the cam actuator provides a high mechanical advantage upon initial opening of the outlet gate to overcome lading forces and static friction on the gate, which provides a lower mechanical advantage after the gate has been initially opened thereby to more rapidly move the gate toward its fully open position, and which further provides a higher mechanical advantage to ensure that the gate is fully opened while insuring that the gate maybe readily manually operated.

The provision of such a low profile outlet gate in which the opening or closing of the outlet gates may be readily manually controlled, and in which an outlet gate may be readily maintained at any desired position between its open and its closed position, regardless of lading forces acting on the gate.

The provision of such a low profile outlet gate having cams and an outlet adaptor so constructed as to be readily molded of a suitable synthetic resin material.

The provision of such a low profile outlet gate in which the valve gates, when closed, are positively maintained in their closed position when one or both of the end caps are installed.

The provision of such a low profile outlet which is of rugged construction, which may be readily fabricated, which operates efficiently to unload a wide variety of pulverulent ladings, which is easy to clean, and which has a long service life.

Other objects and features of this invention will be in part apparent and in part pointed out hereinafter.

Briefly stated, a pneumatic outlet of the present invention is securable to the bottom of a hopper, such as a hopper in a covered railway hopper car. The outlet receives a pulverulent material from within the hopper. The outlet has a pan comprising a pair of opposed, downwardly and inwardly sloping side sheets leading toward an elongate opening generally between the bottom edges of the side sheets, and a pair of end walls. The pan has an elongate outlet tube disposed below and in communication with this opening for receiving pulverulent material through the opening. The tube has a conduit opening at each end thereof with the conduit opening at one of the ends being adapted to be connected to a pneumatic conveying system which moves air through the tube from one end thereof to the other for the entrainment of the pulverulent material as the pulverulent material is discharged into the tube via the opening from the outlet above. Gate means is provided which is operatively associated with the opening for selectively opening and closing the opening with respect to the tube thereby to regulate the flow of the pulverulent material into the tube. The gate means comprises a gate translatable in a generally horizontal plane relative to the opening between its opened and closed positions. A cam mechanism is provided for effecting translation of the gate between its open and closed positions.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
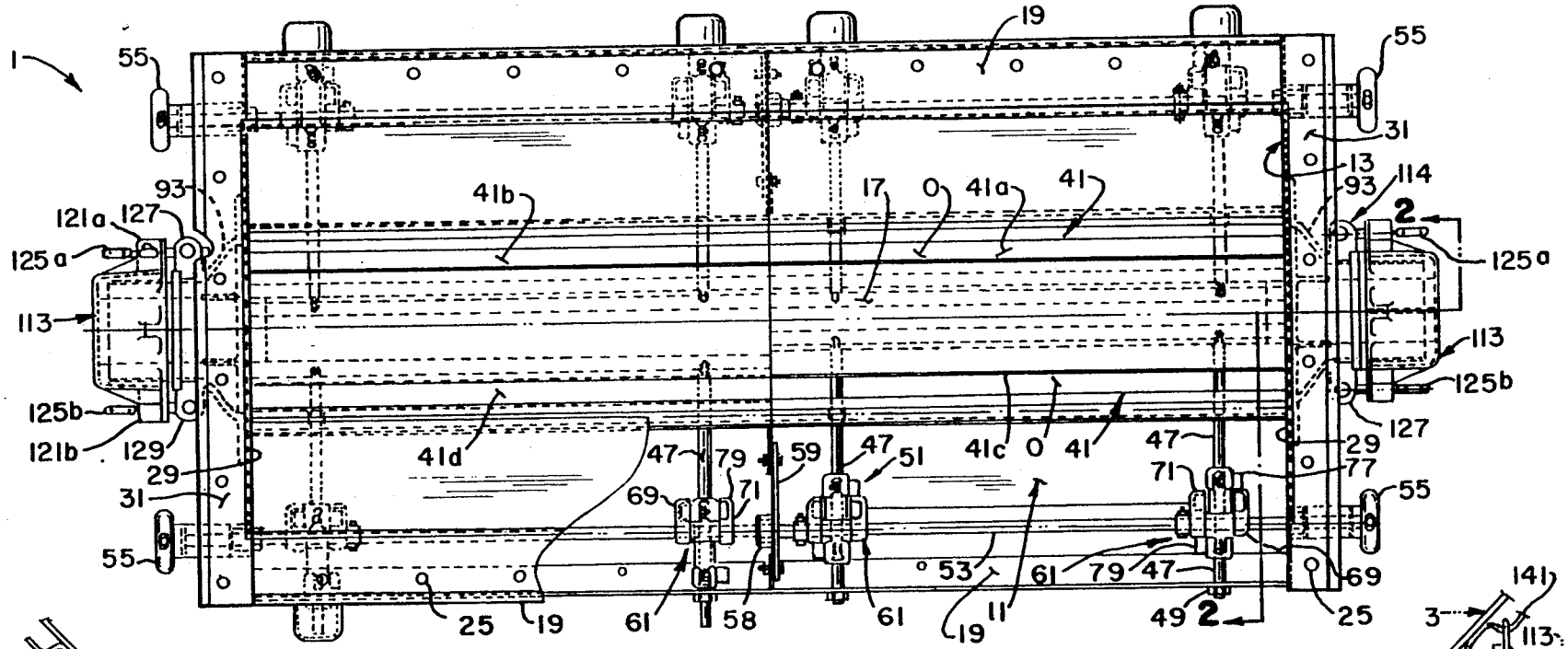
FIG. 1 is a top plan view of a low profile pneumatic outlet of the present invention with portions broken away for illustrating a cam actuator mechanism for effecting generally horizontal, translational movement of outlet gate valves between an open position (as shown in the right hand portion of FIG. 1) and a closed position (as shown in the left hand portion of FIG. 1)
Figure 3:
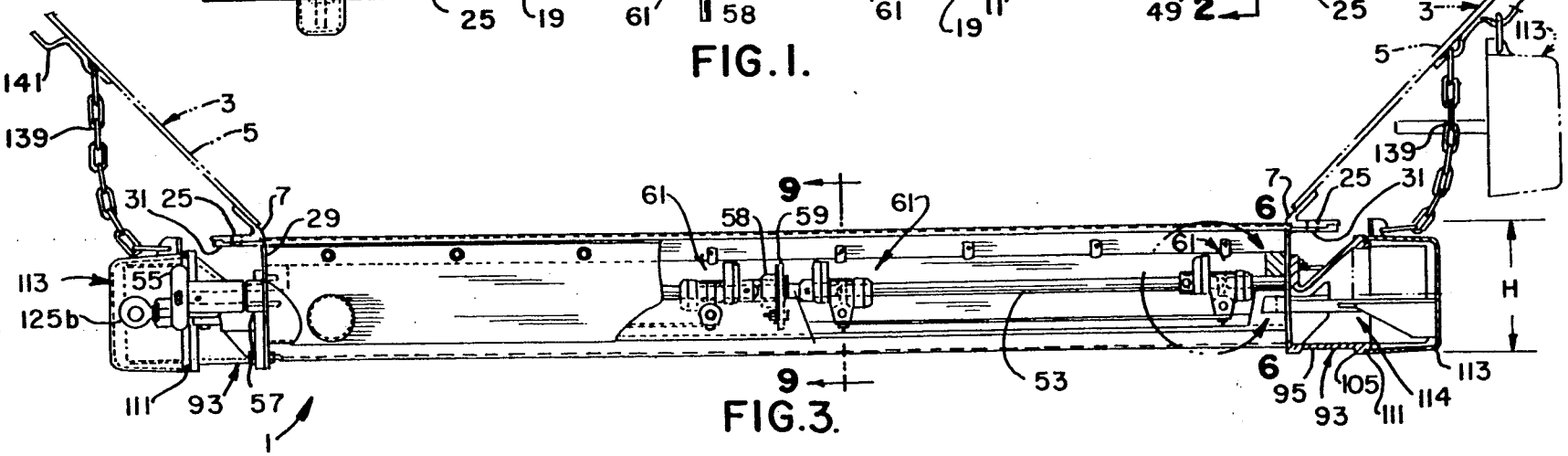
FIG. 3 is a side elevational view of the outlet shown in FIG. 1, with the right most portion of the outlet gate being shown in cross section, and with a cover on the side of the outlet being broken away for illustrating details of the cam actuator mechanism.
Figure 2:
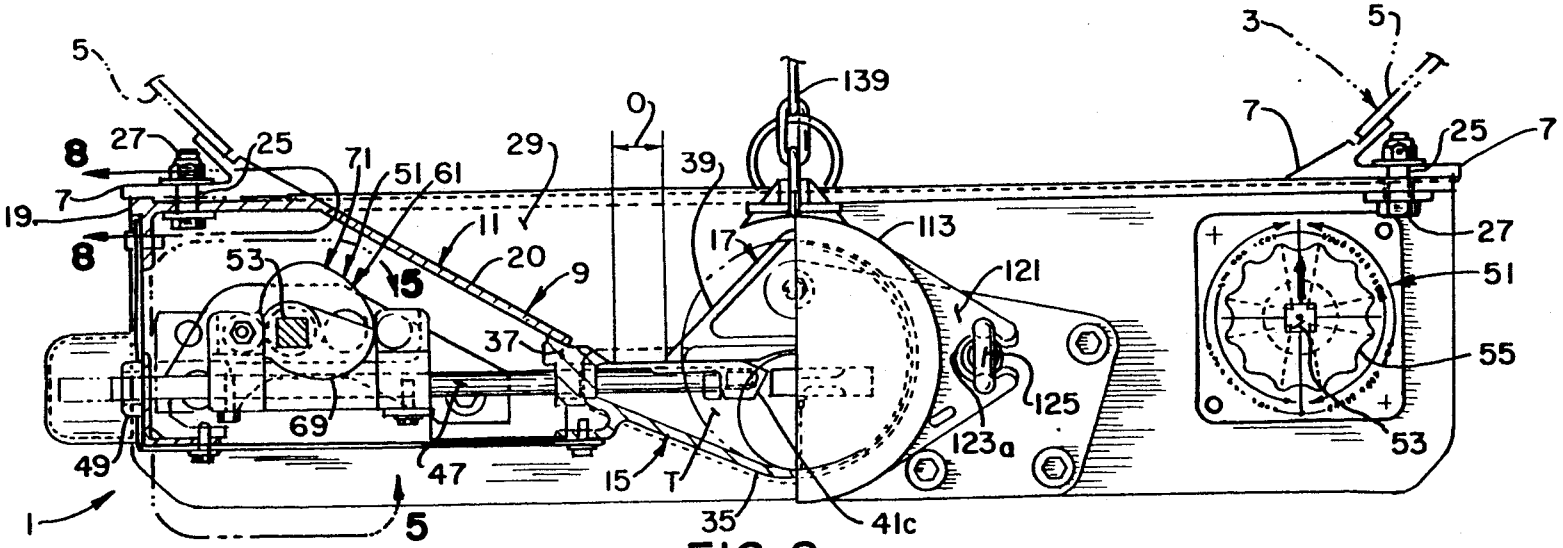
FIG. 2 is an end elevational view, shown on an enlarged scale, with the left hand portion of FIG. 2 being taken along line 2—2 of FIG. 1, showing details of construction of the outlet gate in its open position and a cam actuator for effecting horizontal translational movement of the outlet gate between its open and closed positions.

Referring now to the drawings, and particularly to FIGS. 1–4, a low profile pneumatic outlet of the present invention is generally indicated by reference character 1. As best shown in FIGS. 2 and 3, outlet 1 is intended to be secured or bolted to the lower margins of a hopper 3 (shown in phantom) such as a hopper of a covered hopper railway car or the like. Such covered hopper railway cars are used to transport granular, particulate, powdered, pelletized, or other pulverulent ladings. As shown in FIG. 2, such hoppers have downwardly and inwardly sloping hopper slope sheets 5 which have a hopper frame 7 on their lower ends.

Figure 4:
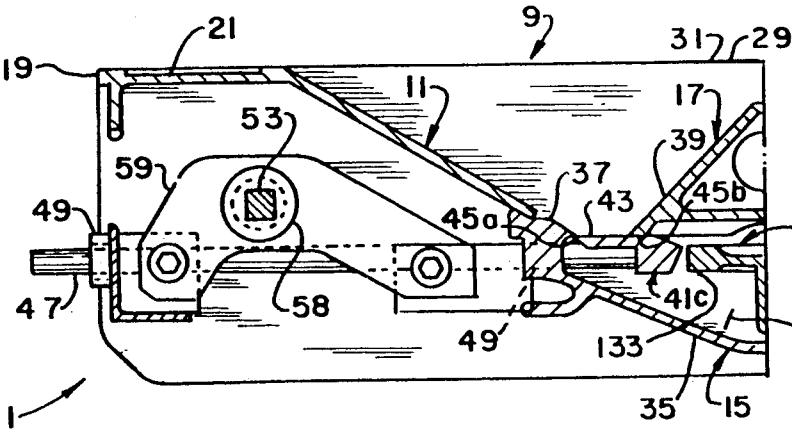
FIG. 4 is a view similar to the left hand portion of FIG. 2, with parts omitted for clarity, showing the gate in its closed position.
Figure 6:
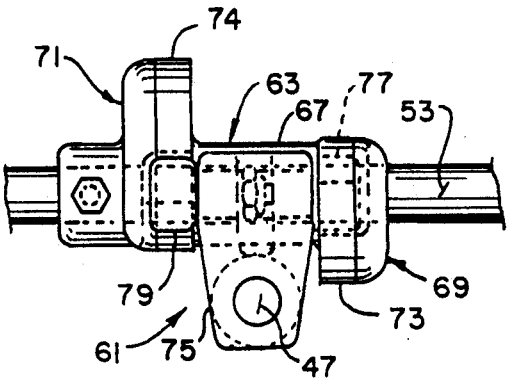
FIG. 6 is a view taken on an enlarged scale along line 6—6 of FIG. 3 illustrating, in side elevational view, certain details of construction of the above noted cam actuator mechanism.
Figure 7:
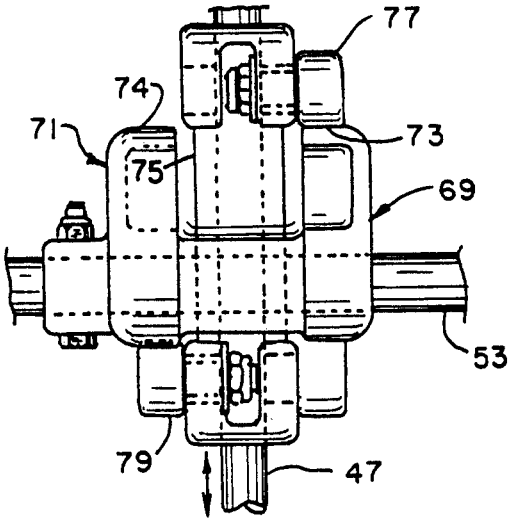
FIG. 7 is a top plan view of the cam actuator mechanism illustrated in FIG. 6.
Figure 9:
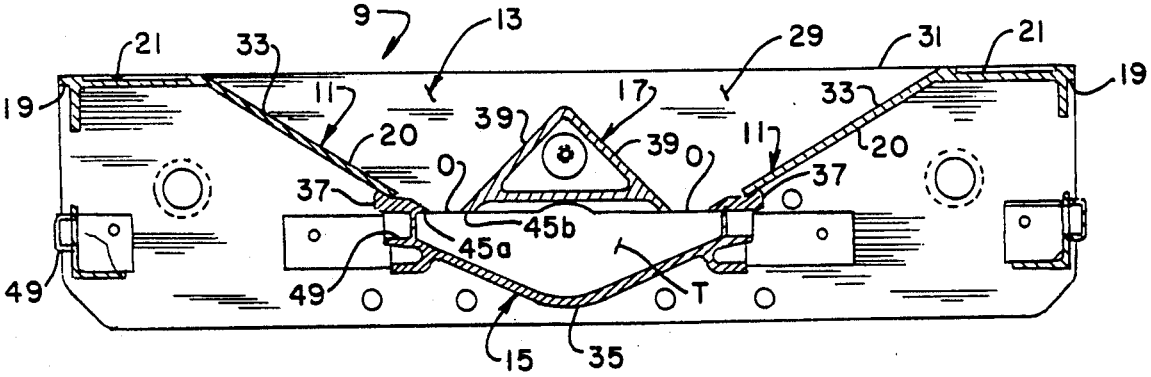
FIG. 9 is a cross sectional view of the outlet pan taken along line 9—9 of FIG. 3, on a somewhat enlarged scale, with a portion of the outlet omitted for purposes of clarity, and for illustrating the structural configuration of the outlet pan.

More specifically, low profile outlet 1 comprises an outlet pan, as generally indicated at 9, as best shown in FIGS. 2, 4 and 9. Outlet pan 9 includes a pair of oppositely disposed side sheets 11 which extend inwardly and downwardly toward the bottom of outlet 1 with the bottom ends of the side sheets being spaced apart from one another for purposes as will appear. Outlet pan 9 also includes an end sheet 13 at each end of side sheets 11. These end sheets are securely fastened (e.g., welded) to ends of the side sheets. Outlet pan 9 further has a bottom structure 15 which is welded to the end sheets and to the bottom margins of side sheets 11. The bottom structure 15 includes an outlet conduit or tube T extending therethrough from one side of the outlet pan to the other thereby to permit the pneumatic conveying of a particulate lading from outlet 1 in a manner as will appear in detail hereinafter. Still further, outlet pan 9 includes a so called divider hood, as generally indicated at 17, positioned between and somewhat above the lower spaced apart margins of side sheets 11.

Figure 8:
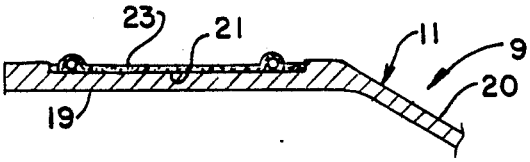
FIG. 8 is a view taken along line 8—8 of FIG. 2, on an enlarged scale, illustrating the construction of the outlet pan flange and a gasket for sealing the outlet pan relative to the bottom of a hopper.
Figure 15:
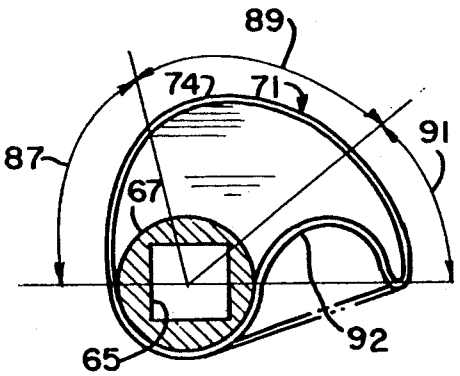
FIG. 15 is a cross sectional view taken along line 15—15 of FIG. 10 illustrating the cam profile of the gate closing cam.
Figure 12:
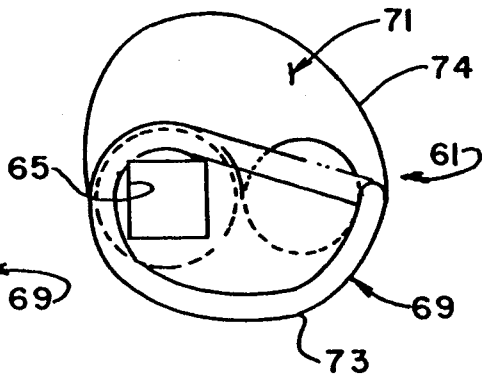
FIG. 12 is a right end elevational view of the cam assembly shown in FIG. 10 illustrating the profile of the gate opening cam.
Figure 13:
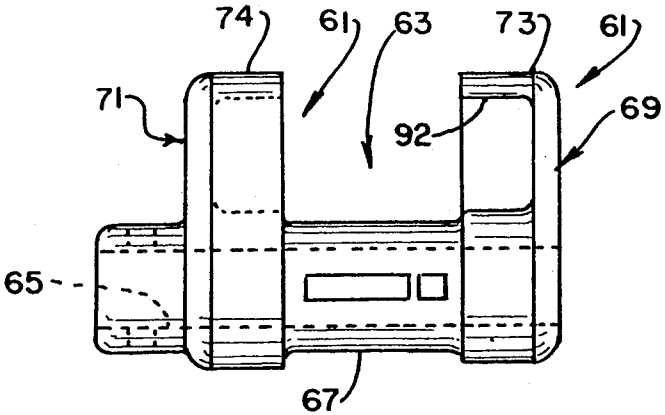
FIG. 13 is a top plan view of the cam assembly shown in FIG. 10.
Figure 10:
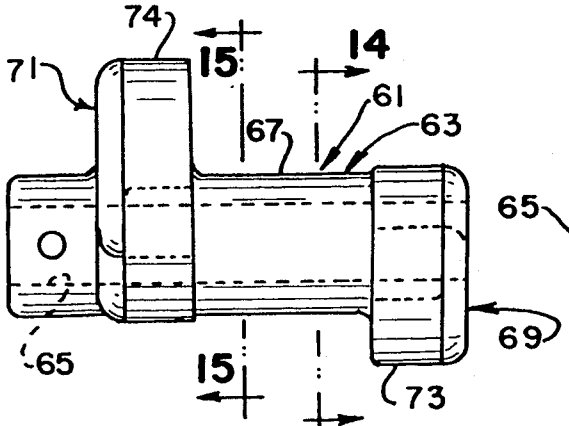
FIG. 10 is a side elevational view of a unitary molded cam assembly, generally as illustrated in FIG. 6, having an opening cam and a closing cam.

As best shown in FIGS. 8 and 9, each side sheet 11 is preferably an aluminum extrusion having a generally horizontal flange 19 at the upper end of a side sheet 20 with which flange 19 is integrally formed. The flanges 19 each have a groove 21 formed therein. Groove 21 is adapted to receive a suitable elastomeric gasket 23, as shown in FIG. 8. As best shown in FIGS. 1–3, flange 19 of outlet 1, and hopper flange 7, are provided with a series of bolt holes 25 which are in registry with one another. It will be understood that gasket 23 has corresponding bolt holes (not shown) so with outlet 1 installed on hopper frame 7, in the manner shown in FIGS. 2 and 3, bolts 27 (as shown in FIG. 2) may be inserted through the flanges and tightened. This secures the outlet onto the hopper frame and also compresses the gasket so as to seal the outlet with respect to the hopper frame.

Likewise, end sheets 13 are preferably aluminum extrusions having generally vertical end walls 29 with integral end wall flanges 31 extending outwardly therefrom. In the preferred manner of construction of outlet pan 9, the end sheet extrusions 13 are welded to the side sheet extrusions 11, along the intersections thereof, so as to form a one piece weldment. weld lines 33 are provided between the side sheet extrusions and end sheet extrusions.

To complete the outlet pan 9 weldment, bottom structure 15, which is preferably integral aluminum extrusion, is welded in place to the lower margins of side walls 20, as shown in FIG. 2, and also to end walls 29. Bottom structure 15 has a lower wall 35 with an upper sealing flange 37 which is welded to the bottom margins of side walls 20, as heretofore discussed.

Divider hood 17 also comprises a unitary aluminum extrusion having sloping divider walls 39 which extend generally downwardly from an upper portion along the centerline of the outlet pan down toward the bottom margins of side walls 20 and sealing flanges 37 of bottom structure 15 so as to define outlet openings 0 (as best shown in FIGS. 2 and 9) between the bottom margins of divider walls 39 and side walls 20.

As generally indicated at 41, a plurality (e.g., four) gates or valves are slidably translated in a horizontal plane between an open position (as shown in FIG. 2, and in the right hand portion of FIG. 1) and a closed position (as shown in FIG. 4, and in the left hand portion of FIG. 1) such that when one or more of the gates is in its open position, a pulverulent material within hopper 3 flows downwardly along side walls 20 and drops through the opening into outlet tube T from which it is air conveyed from outlet 1 in a manner well known to those skilled in the art. Each gate 41 has an upper gate surface 43 (as shown in FIG. 4) which slidably sealably engages respective gate sealing surfaces 45*a* (on sealing flange 37 of bottom structure 15) and 45*b* (on a downwardly facing surface of divider wall 39 of hood structure 17). Gate 41 is slidably mounted on cradle shafts 47 sealing surfaces 45*a*, 45*b* between its open and closed position. Cradle shafts 47 are slidably mounted in bushings or slidable bearings 49.

As generally indicated at 51 in FIG. 2, a cam means is provided for effecting horizontal, sliding, translational movement of gates 41 between their opened and closed positions. Cam means 51 comprises an elongate rotary cam shaft 53 (preferably of square cross section) which extends lengthwise of outlet 1 and through appropriate openings in end walls 29 of outlet pan 9. A suitable manually operable knob 55 (see FIGS. 1 and 2) is affixed to each end of each cam shaft so an operator may manually operate cam actuating means 51, for selective manual movement of each of the outlet gates between its opened and closed positions, from both sides or ends of outlet 1. As shown in FIG. 1, there are four such gates, as indicated at 41*a*–41*d*, each moveable between its open and closed position independently of the others. For convenience, gates 41*a*, 41*c* are referred to as the near gates and gates 41*b*, 41*d* are referred to as the far gates. Elongate rotary cam shaft 53 is supported at each end by bearings 57 (as shown best at the left hand portion of FIG. 3) and is supported at its center portion by another bearing 58 carried by a center bearing support 59.

Specifically, cam means 51 comprises a plurality of cam assemblies 61 mounted on camshaft 53, two for each of the near side gates and two for each of the far side gates. The cam assemblies for the far side gates are mounted on the respective camshaft, 53, 180° out-of-phase with the cam assemblies for the near side gates, such that rotation of knob 55 through one-half turn in one direction effects opening and closing of only the near side gate and rotation of the knob in the opposite direction effects opening and closing of only the far side gate. It will be understood that opening movement of a gate is an inward movement of the gate toward the centerline of the outlet; while the closing movement of the gate is movement in the reverse, outward direction.

Figure 5:
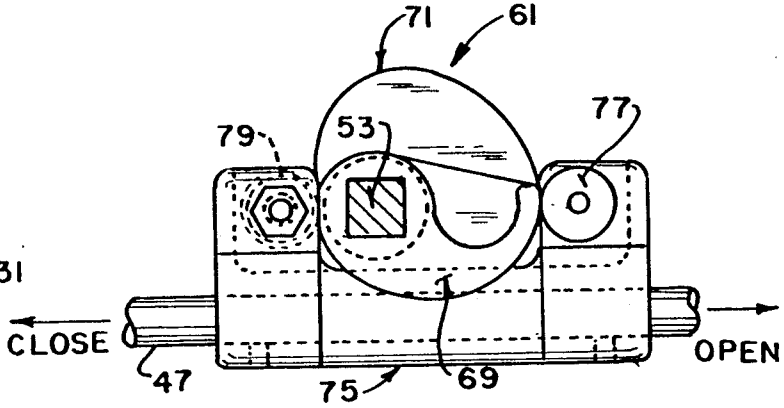
FIG. 5 is a view taken along line 5—5 of FIG. 2, on an enlarged scale, illustrating details of construction of the cam actuator mechanism for opening and closing of the outlet gate.

Each cam assembly 51 comprises a unitary cam member 63, as best shown in FIGS. 6, 7, and 10–15. Each unitary cam member 63 has a square cam shaft aperture 65 therethrough for receiving the cam shaft 53 so the cam member rotates with the cam shaft. Unitary cam member 63 includes a cam body 67 having an opening cam 69 and a closing cam 71. Opening cam 69 has an opening cam surface 73 on the outer face thereof and closing cam 71 has similar closing cam surface 74 on its outer face. A cradle, as generally indicated at 75 (see FIG. 5), is affixed to cradle shaft 47 and carries an opening cam follower 77 and a closing cam follower 79 in operative camming engagement with respective opening cam surface 73 and closing cam surface 74. This is to effect opening and closing of respective gates 41 upon rotary operation of cam shaft 53 turning a manually operable knob 55. In this manner, opening cam 69 and closing cam 71, in operative association with cradle 75 and the respective cam followers 77 and 79 thereon, constitute a desmodromic cam actuator in which one of the cams positively effects opening of the gates and in which another of the cams positively effects closing of the gates.

In accordance with this invention, the profiles of the opening cam 69 and the closing cam 71 of each cam assembly 61 are such that initially, i.e., upon initial manual turning of knob 55 in one direction, the cam assemblies for one of the gates (e.g., the near side gate) have their opening cam faces 73 in camming engagement with opening cam follower 77. Opening cam faces 73 have a relatively high mechanical advantage. This advantage, when applied to gate 41, readily overcomes the static friction of cradle shafts 47 within their bushings 49. It further overcomes the static friction created by the sealing fit between the gates and their respective seat surfaces 45*a*, 45*b* on the bottom faces of sealing flange 37, and on the bottom edges of the divider walls 39.

Figure 14:
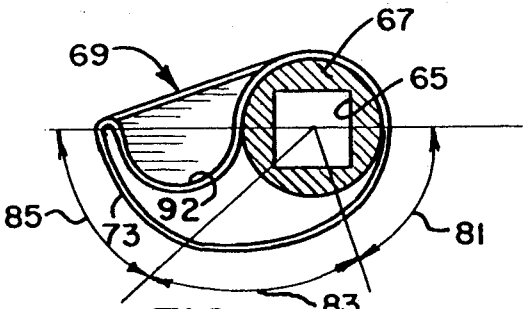
FIG. 14 is a cross sectional view taken along line 14—14 of FIG. 10 illustrating the profile of the gate opening cam.
Figure 11:
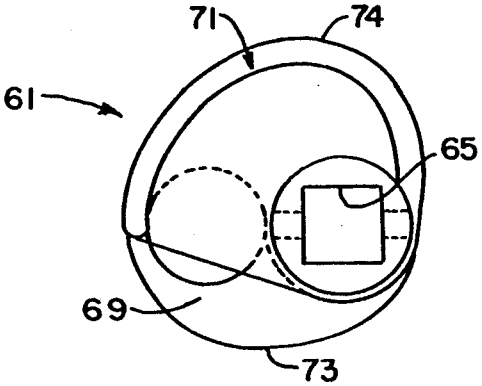
FIG. 11 is a left end elevational view of the unitary cam member illustrated in FIG. 10 illustrating the profile of the gate closing cam.

As best shown in FIG. 14, a first segment 81 of the profile of opening cam face 73 has the relatively high mechanical advantage referred to above. Further, cam surface 73 has an adjacent profile segment 83, which provides a lesser mechanical advantage to produce a relatively fast translational movement of the gate toward its fully opened position. Lastly, cam surface 73 has a third profile segment 85, which is adjacent segment 83. This last segment has a medium-to-high mechanical advantage to insure the gate is fully retracted in its open position.

With knob 55 rotated one-half turn in one direction, to fully open one of the gates 41 (e.g., near side gate 41*c* in its FIG. 2 position), rotation of knob 55 one-half turn in the opposite direction will close this gate without causing movement of the other gate, i.e., far side gate 41*d*. With rotation of knob 55 to effect closing movement of gate 41*c* (all FIG. 4), opening cam 73 for that gate is moved clear of its associated cam follower 77 and the closing cam surface 74 for near side gate 41*c* cammingly engages the closing cam follower 79 for the gate. Further, each closing cam surface 74 has a first segment 87 with a relatively high mechanical advantage to readily break the gate loose from its fully opened position and effect its movement towards its closed position. This, even though particles of lading or the like may have become wedged between the upper face of the gate and the intersection between upper face 43 of the gate and sealing surface 45*a* of flange 37. Closing cam surface 74 has an intermediate cam profile segment 89 of a lesser mechanical advantage to effect a more rapid movement of gate 41*c* toward its closed position. Lastly, cam surface 74 has a third cam surface segment 91 which has a higher mechanical advantage than segment 89, to insure the gate positively closes in sealing engagement with seat surfaces 45*a*, 45*b* on upper sealing flange 37, and on the bottom surfaces of divider walls 39.

Since, for example, both gates 41*c* and 41*d* are operated by the same cam shaft 53, with gate 41*c* closed, and upon rotating knob 55 in the opposite direction, as previously discussed, gate 41*d* (i.e., the far side gate) is caused to open while gate 41*c* (the near side gate) remains in its closed position.

The cam assemblies for gate 41*c* and for gate 41*d* on the one cam shaft 53 are 180° out-of-phase with one another. This insures that as knob 55 and camshaft 53 are rotated in one direction, only one of the gates is opened. The same is true with the cam assemblies for the gates 41*a* and 41*b* on the other cam shaft 53. Also, each cam 69 and 71 on each cam assembly 61 is provided with a cam follower receiving pocket 92 (see FIGS. 14 and 15). Thus, for example, as knob 55 and cam shaft 53 are rotated one-half turn in one direction, to effect full opening of near side gate 41*c*, the cam assemblies 61 for gate 41*d* also rotate with the camshaft, even though their cam surfaces are out of camming engagement with the cam followers for this gate. As gate 41*c* is moved to its fully opened position, the cam follower pockets 92 in the opening and closing cams 69 and 71 for the other gate 41*d* receive the respective cam followers 77, 79 for that gate. This positively prevents further rotation of cam shaft 53 in this gate 41*c* opening direction.

With horizontally translatable gates 41, and with the positive cam opening and cam closing means 51 for opening and closing the gates, the overall height of outlet 1 of the present invention is substantially lower than the overall height of such prior art outlets; particularly in comparison with rotary valve outlet gates as shown in the prior art patents heretofore mentioned, and more particularly as shown in the previously mentioned U.S. Pat. Nos. 3,701,460 and 4,151,935. This reduction in outlet height is achieved even though the angles of sidewalls 11 of outlet pan 9 are at substantially the same angle as shown in these prior art patents so as to insure a pulverulent lading will unload equally well from the low profile outlet 1 of the present invention as with the more conventional prior art outlets. By way of comparison, the height of outlet 1 from the bottom reaches of the tube T to the level of flanges 19 is approximately five inches (5″) less than the height of the outlets in the above-noted prior art. It will be understood that the bottom reaches of the low profile outlet (i.e., the bottom reaches of the bottom structure 15) are positioned above the height of the rails upon which a railroad car equipped with these outlets operates. This reach may be at a minimum height above the rails, as required by the Association of American Railroads (AAR). However, the height of outlet flanges 19, relative to the rails, is substantially lower than for similar outlet flanges of a more conventional outlet such as shown in my prior U.S. Pat. No. 3,701,460. This allows the bottom margins of the hopper slope sheets 5 of the hopper car to be extended downwardly towards the rails; which, in turn, increases the lading carrying capability of the railcar. This helps maximize the lading carrying volume of the car while remaining within AAR specifications. Also, desired angles on the hopper slope sheets 5 and on the side sheets 11 of the outlet pan of the present low profile outlet are maintained, thereby insuring outlet 1 of the present invention will perform essentially at the same unloading rates as prior art outlets.

Additionally, the positively opened and closed cam actuator means 51 for gates 41 insure ready manual operation of the gates so as to overcome static friction and the weight of the lading bearing on the gates, to insure rapid movement of the gates from their initially open position to their fully open position, and to positively maintain the gates in any desired intermediate position during unloading; thereby to regulate flow of lading from the hopper into outlet tube T. The cam closing means also insures that a train attendant can readily apply sufficient torque on knob 55 to open and close gates 41.

Figure 24:
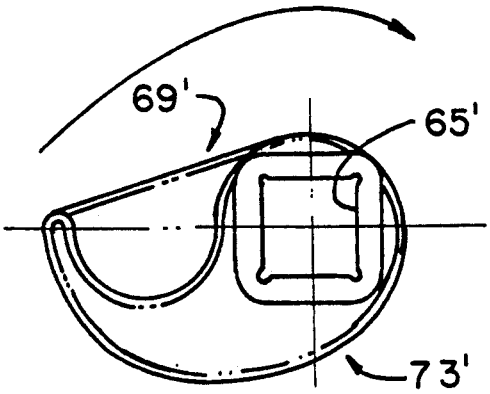
FIG. 24 is a cross sectional view of a second embodiment of the gate opening cam illustrating the profile thereof; and, FIG. 25 is a cross sectional view of a second embodiment of the gate closing cam illustrating the profile thereof.
Figure 25:
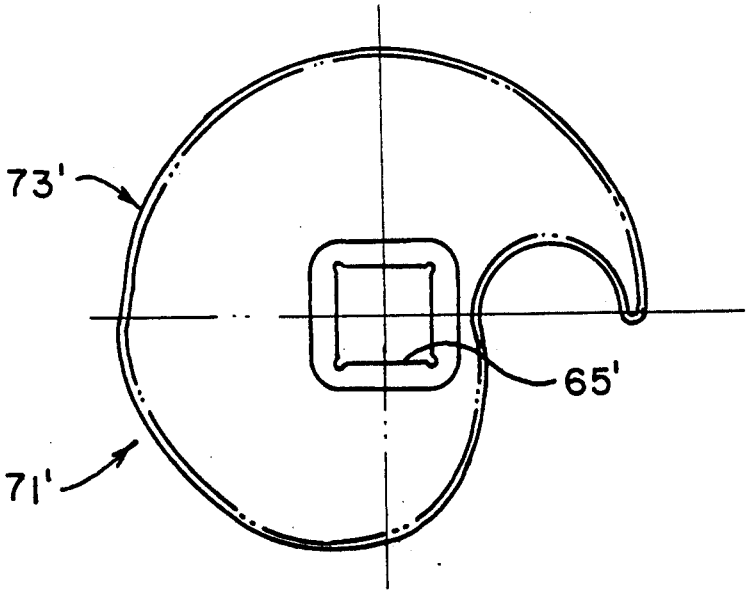

Referring to FIGS. 24 and 25, alternate embodiments of the opening and closing cams are designated 69' and 71' respectively. The cams are preferably molded of a suitable synthetic resin material; for example, they may be injection molded from Zytel 70G-33L glass reinforced, type 66 nylon, which is commercially available from DuPont. Each cam is similar in construction and operation to the cams 69 and 71 previously described. Specifically, each cam has a square cam shaft aperture 65, In addition, opening cam 69' has a cam face 73' with a relatively high mechanical advantage. The cam profile however differs slightly from that of the profile of cam face 73. This is because cam 69' is somewhat larger than cam 69. The size difference is due to cam 69' now being large enough that it abuts cam follower 77 when the gate with which the cam is associated is closed and knob 55 is rotated to open the other gate on cam shaft 53.

Closing cam 71' has a cam face 73' whose profile differs slightly from that of cam face 73 for the same reason. That is, cam 71' is also now large enough it abuts cam follower 79 when the gate with which the cam is associated is closed and knob 55 is rotated in the opposite direction to open the other gate on cam shaft 53.

With cams 69 and 71, as noted previously, the cams were out of contact with their respective cam followers when knob 55 was rotated to open the other gate on shaft 53. In this situation, a longitudinal force on the railcar, such as an impact force when one car is bumped into another could inadvertently move the gate laterally along the cradle shafts 47 and thereby misalign the gate. By substituting cams 69' and 71' for the respective cams 69 and 71, this potential problem is alleviated.

Further in accordance with this invention, low profile outlet 1 is provided with a low profile outlet adaptor, as generally indicated at 93, so as to serve as a transition between the generally flattened shape of the outlet tube T defined by bottom structure 15, and the circular cross section of conventional pneumatic unloading hoses or tubes (not shown) which are utilized to pneumatically convey a pulverulent lading from the outlet to a storage tank or the like.

Figure 19:
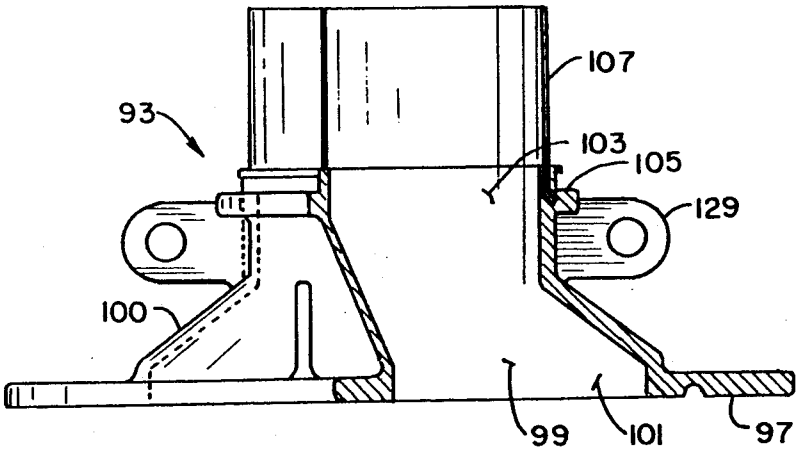
FIG. 19 is a view of the outlet adaptor shown in FIG. 18 with portions broken away and shown in section.
Figure 16:
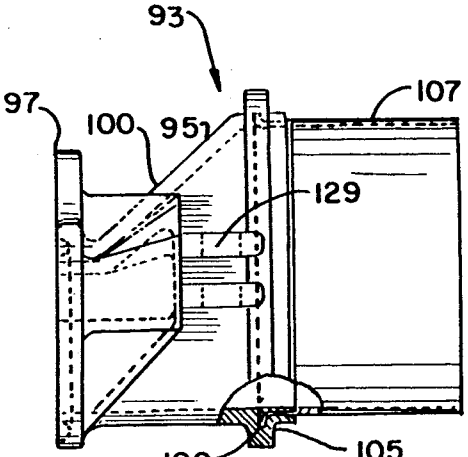
FIG. 16 is a side elevational view of a unitary outlet adaptor which is to be secured (bolted) to one end of the outlet pan in communication with a tube or channel extending through the outlet pan and having a cylindric end or sleeve enabling a pneumatic conveying hose (not shown) to be readily connected to the outlet.
Figure 18:
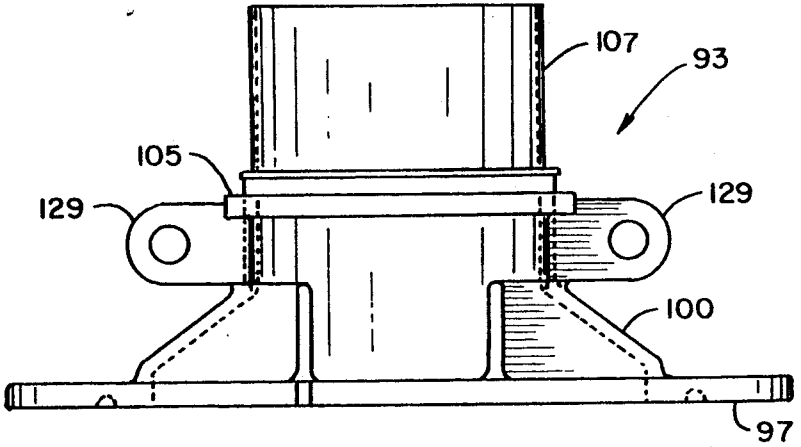
FIG. 18 is a top plan view of the outlet adaptor shown in FIG. 17.
Figure 17:
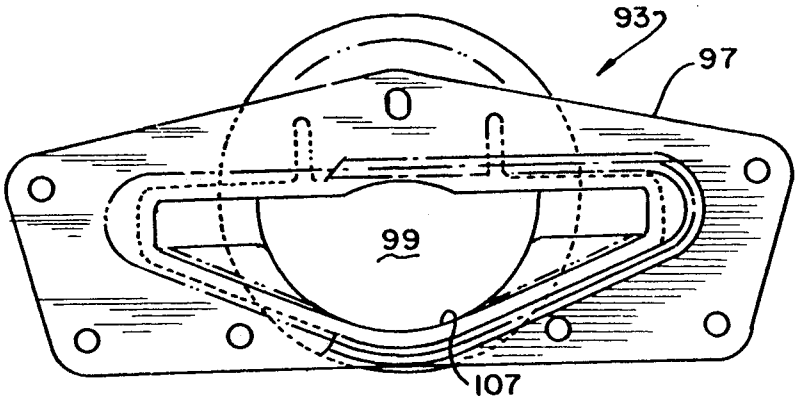
FIG. 17 is a rear elevational view of the outlet adaptor illustrated in FIG. 16.
Figure 23:
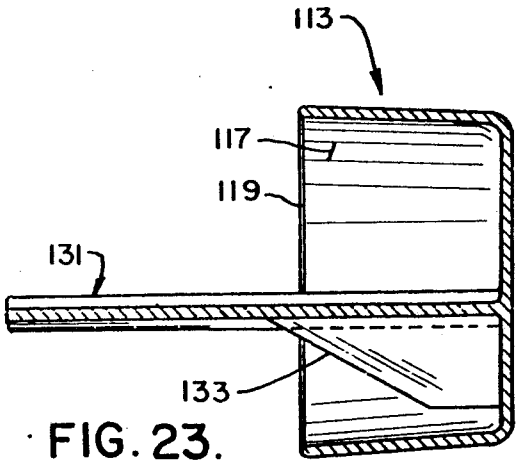
FIG. 23 is a vertical cross sectional view of the cap taken along line 23—23 of FIG. 21.
Figure 20:
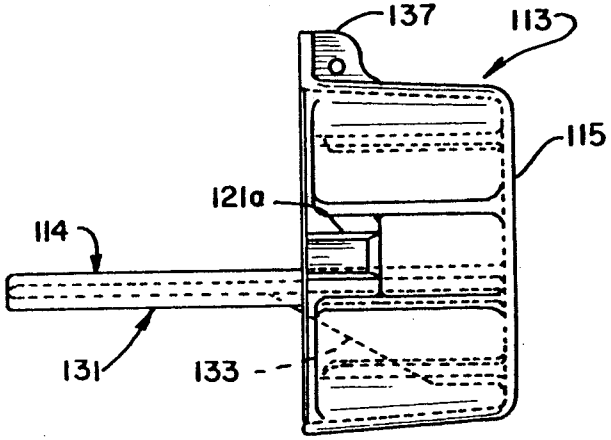
FIG. 20 is a side elevational view of a cap for closing the adaptor shown in FIGS. 16–19 with the cap having a probe extending inwardly from the base of the cap and adapted to cooperate with the gates in the outlet, in the manner shown in FIG. 4, so as to positively block movement of one or both of the gates from their respective closed toward their open positions when one or both of the caps are in place on the outlet.
Figure 22:
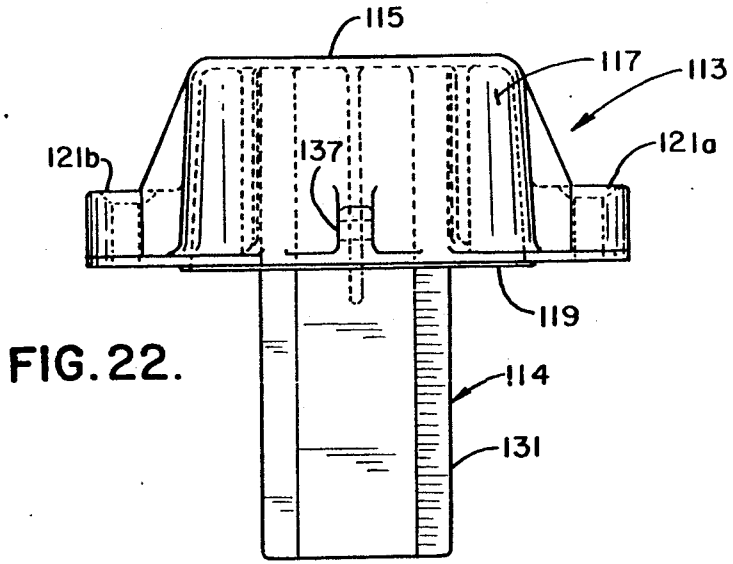
FIG. 22 is a top plan view of the cap illustrated in FIG. 21.

More specifically, low profile outlet adaptor 93 has an adaptor body 95 preferably molded of a suitable synthetic resin material. Adaptor body 95 may be injection molded from a suitable nylon material, such as Zytel ST-901, commercially available from DuPont. Adaptor body 95 includes a mounting flange 97 adapted to be bolted in face-to-face engagement with end wall 29 of outlet pan 9. An adaptor passage 99 is generally of, the shape of and is in registry with, the opening of outlet tube T in outlet pan 9. Adaptor body 95 serves as a transition 100 between the shape of outlet tube T and the generally circular cross section of the pneumatic conveying hose (not shown) such that the cross sectional areas of outlet tube T and the outlet hose are preferably (but not necessarily) substantially equal. As best shown in FIG. 19, one end of passage 99, referred to as its inlet end 101, is in registry with outlet tube T.

At the outer end of adaptor body 95, a cap flange 105 is integrally molded with the adaptor body. Further, a molded-in-place metal adaptor sleeve 107 extends endwise from the molded adaptor body. The inner end of sleeve 105 has a sleeve securement flange 109 extending radially outwardly from the sleeve. In fabrication of adaptor 93, the metal sleeve 107 is placed within a suitable injection mold (not shown) used to form adaptor body 95. Molten resin is forced into the mold so to surround the base of the sleeve 105 and to surround flange 109. Upon removal of the adaptor body from the mold, the sleeve is rigidly molded-in-place and is rigid with respect to the adaptor body. Alternatively, the adaptor body, sleeve and flange may all be integrally molded of the suitable nylon material.

Sleeve 107 has a slight taper so to receive the inner diameter of a pneumatic conveying hose or the like and to be substantially in sealing engagement therewith. As is well known, the pneumatic conveying hose adapted to be received on sleeve 107 may be provided with suitable locking arrangements engageable with flange 105, for positively holding the hose in place on outlet adaptor 93. As best shown in FIG. 3, a compressible gasket 111 is provided against the outer face of flange 105 for sealable engagement with an outlet cap, as will be described hereinafter.

Referring now to FIGS. 20–23, an outlet cap of the present invention, as indicated generally at 113, is shown. This cap may be readily, sealably secured in place on outlet sleeve 107, and positively sealed in place on the outlet adaptor to compress gasket 111 between the mouth of cap 113 and flange 105. This positively seals outlet tube T to protect the lading within the railway hopper car from dirt, contamination, moisture, and the like.

In addition, cap 113 is provided with means 114, as shown in FIG. 1, for preventing opening of gates 41 when one or both of the caps are in place on one of the outlet adaptors 93 at either end of outlet tube T. This insures that gates 41 are not inadvertently opened. The gates cannot be opened until such time as both outlet caps 113 are removed. For example, because the outlet cap 113 on the opposite side of the outlet (i.e., the far side cap on the opposite side of the railcar) is not visible to a train attendant, the attendant may remove one cap and properly connect a pneumatic conveying hose to the outlet adaptor, and then attempt to begin pneumatically unloading the lading. However, with the far side outlet cap in place, air flow through outlet tube T cannot be established. If the attendant could proceed to open the gates 41 with the far side outlet cap still in place, lading would fill the outlet tube and prevent proper establishment of flow through the outlet tube.

Further, means 114 prevents vandals from removing a cap and opening the outlet gates.

Figure 21:
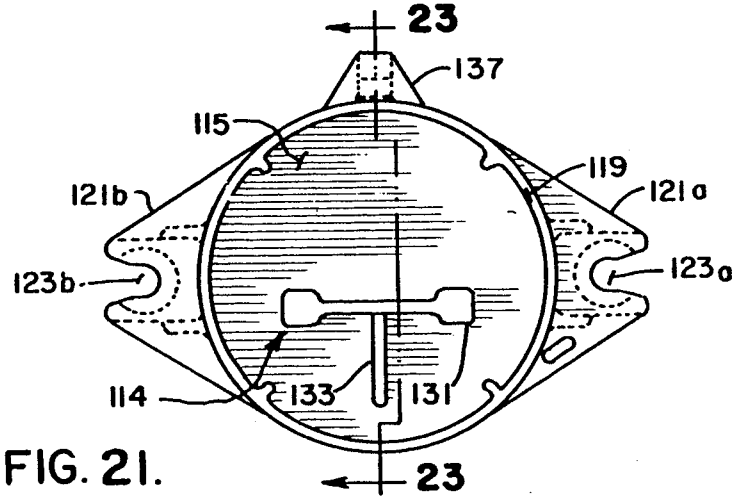
FIG. 21 is a rear elevational view of the cap shown in FIG. 20.

Outlet cap 113 is preferably molded of a suitable synthetic resin, such as glass fiber filled Nylatron; or, as an alternative, DuPont ST801 Zytel, commercially available from DuPont. The cap has a base 115 and generally circular sidewalls 117 extending from the base with the ends of the sidewalls defining a cap mouth 119. At each side of the cap, ears 121*a*, 121*b* extend outwardly on opposite sides of the cap. These ears have respective slots 123*a*, 123*b* therein, as best shown in FIG. 21. Referring to FIGS. 1 and 3, a pair eye bolts 125*a*, 125*b* are pivotally mounted by pins 127 carried in lugs 129 integrally molded on adapter body 93. With cap 113 in place on the outlet adaptor, and with eye bolts 125 swung inwardly toward the cap, so as to be received in respective slots 123*a*, 123*b*, the eye bolts may be tightened so to draw mouth 119 of cap 113 into sealing engagement with the gasket 111 interposed between cap mouth 119 and the shoulder 105 provided on adaptor body 95.

As noted above, means 114 is provided on cap 113 for preventing opening of gates 41 when one (or both) of the caps 113 is in place on its respective outlet adaptor 93. More particularly, means 114 comprises a probe or finger 131 extending endwise from the base 115 of cap 113 out beyond the end of the cap mouth 119. With the cap in place on the outlet adaptor, the probe or finger 131 is disposed adjacent the inner end of gates 41 below divider 17 so with the cap in place, fingers 131 are engaged by the gates as they move inwardly under divider 17 from their fully closed toward their open positions (see FIG. 4). Thus, probe 131 positively blocks the opening of any of the gates.

Numerous variations, within the scope of the appended claims, will be apparent to those skilled in the art in light of the foregoing description and accompanying drawings.

I claim:

1. A pneumatic outlet for a hopper, said outlet being securable to the bottom of said hopper for receiving a pulverulent material from within said hopper, said outlet having a pan comprising a pair of opposed downwardly and inwardly sloping side sheets leading toward an elongate opening generally between the bottom edges of said side sheets, and a pair of end walls, an elongate outlet tube disposed below and in communication with said opening for receiving said pulverulent material, said tube having a conduit opening at leach end thereof for connection to a pneumatic conveying system which moves air through said tube from said one end to the other to entrain said pulverulent material in said air as it is discharged into said tube from said elongate opening; gate means operatively associated with said elongate opening for selectively opening and closing said outlet with respect to said tube to regulate flow of pulverulent material into said tube, said gate means comprising a gate translatable in a generally horizontal plane between its open and closed positions; and, cam means for effecting translation of said gate between its said open and closed positions, said cam means comprising a cam shaft extending generally parallel to said gate means and being spaced therefrom, an opening cam and a closing cam affixed to and rotatable with said cam shaft, an opening follower in camming engagement with said opening cam and a closing follower in camming engagement with said closing cam, and means interconnecting said cam followers and said gate means so upon rotation of said cam shaft said cams effect opening or closing movement of said gate means.

2. A pneumatic outlet as defined in claim 1 wherein said means interconnecting said cam followers and said gates means comprises at least one cradle shaft slidably mounted with respect to said pan for translational movement of said gate between its closed and open positions, said cradle shaft having a cradle thereon with said cradle mounting said followers for camming engagement with said opening and closing cams.

3. A pneumatic outlet as defined in claim 2 wherein each said opening cam and closing cam has a cam face, said opening cam face of said opening cam having a first segment with a first mechanical advantage in relation to rotation of said cam shaft for initially applying a sufficiently high force on said gate means to overcome its resistance to movement while requiring a torque level which may be readily manually applied to said cam shaft by an operator.

4. A pneumatic outlet as defined in claim 3 wherein said opening cam face has an intermediate segment with a second mechanical advantage which is less than that of said first segment for effecting relatively rapid movement of said gate means.

5. A pneumatic outlet as defined in claim 4 wherein said opening cam face has a third segment with a third mechanical advantage which is greater than that of said intermediate segment so to effect sealing of said gate means with respect to said outlet pan and said divider.

6. A pneumatic outlet as defined in claim 1 wherein each said opening cam and closing cam has a cam face cammingly engageable with said opening follower and with said closing follower, respectively, said closing cams for one of said gate means being clear of their said closing followers upon rotation of said cam shaft to effect opening of said one gate means and said opening cams for said one gate means being clear of their respective opening cam followers upon rotation of said cam shaft to effect closing of said one gate means.

7. A pneumatic outlet as defined in claim 6 having two of said elongate openings, one on each side of a longitudinal centerline of the outlet, and two of said gate means, one for each of said elongate openings, and wherein each of said gate means comprises a first or near side gate and a second or far side gate, wherein said cam means constitutes at least one opening cam and one closing cam operatively associated with said first or near side gate and at least one opening cam and one closing cam operatively associated with said second or far side gate, and wherein the opening and closing cams for said near side gate and the opening and closing cams for said far side gate are oriented with respect to one another on said camshaft such that rotation of said camshaft in one direction from a starting position, to open said near side gate, and subsequent rotation of said camshaft back thereto, to close said near side gate, does not produce movement of said far side gate to move from its closed position, rotation of the cam in the opposite direction from the starting position, to open said far side gate, and subsequent rotation of said camshaft back thereto, to close said far side gate, does not produce movement of said near side gate to move it from its closed position.

8. A pneumatic outlet as defined in claim 7 wherein at least one of said opening or closing cams associated with each of said gates has a surface therein engageable with its respective cam follower, upon rotation of said cam shaft in one direction, so to positively stop rotation of said cam shaft in said direction.

9. A pneumatic outlet as defined in claim 8 wherein the opening and closing cams associated with one of said gates remain in contact with their associated cam followers when the cam shaft is rotated in the direction to open the other of said gates thereby to prevent inadvertent movement of the one said gate and misalignment of the gates.

10. A pneumatic outlet as defined in claim 9 wherein the cams are molded of a suitable resin material.

11. A pneumatic outlet as defined in claim 1 wherein said pan has an end wall at each end thereof, each said end wall having an opening therein in registry with said tube, and said outlet having an adaptor having a passageway therethrough in communication with said tube opening in said end wall, said passageway in said adaptor serving as a transition between said tube and a conduit attachable to said adaptor for pneumatically conveying said pulverulent material from said outlet.

12. A pneumatic outlet as defined in claim 11 wherein said adaptor has an adaptor body molded of a suitable resin material, and a metal conduit sleeve for receiving said conduit, said sleeve being molded-in-place within said adaptor body and having an integral flange at one end thereof, said flange being embedded in said adaptor body upon molding of said adaptor body.

13. A pneumatic outlet as defined in claim 11 wherein said adaptor has an adaptor body, a conduit sleeve for receiving said conduit and having a flange at one end thereof, said adaptor body, conduit sleeve and flange being integrally formed.

14. A pneumatic outlet as defined in claim 13 wherein said adaptor body, conduit sleeve and flange are molded of a suitable resin material.

15. A pneumatic outlet as defined in claim 11 wherein said adaptor has a sleeve for receiving a conduit for pneumatically conveying said pulverulent material from said outlet, and a cap for sealably closing each said adaptor sleeve, each said cap having means for preventing opening of said gate means with one or both of said caps in place.

16. A pneumatic outlet as defined in claim 15 having two gate means, one of which is on each side of a longitudinal centerline of the elongate opening, and each of said gate means comprises a gate translatable inwardly toward said longitudinal centerline in a horizontal direction from its closed to its open position, and said means for preventing opening of said gate comprising a probe carried by said cap and extending inwardly of the outlet from said cap between said gates on opposite sides of said longitudinal centerline whereby upon initial movement of one or both of said gates inwardly from its closed to its open position, said gate engates said probe which blocks further opening movement thereof.

17. A pneumatic outlet for a hopper, said outlet being securable to the bottom of said hopper for receiving a pulverulent material from within said hopper, said outlet having a pan comprising a pair of opposed downwardly and inwardly sloping side sheets leading toward an elongate opening generally between the bottom edges of said side sheets, and a pair of end walls, said outlet further comprising an elongate outlet tube disposed below and in communication with elongate for receiving said pulverulent material, said tube having a conduit opening at each end thereof adapted for connection to a pneumatic conveying system which moves air through said tube from said one end to the other to entrain said pulverulent material in said air moving through said tube; gate means operatively associated with said elongate opening for selectively opening and closing said outlet with respect to said tube to regulate flow of pulverulent material into said tube, said elongate outlet having a longitudinal centerline and said gate means comprising a gate on each side of said centerline translatable in a generally horizontal plane between its open and closed positions; and, cam means for each of said gates effecting translation of each said gate between its said open and closed positions.

18. A pneumatic outlet as defined in claim 17 comprising a divider secured to said pan and extending longitudinally of said pan generally above said elongate opening, said divider having first and second downwardly sloping side walls sloping downwardly toward a respective said side sheet for dividing said elongate opening into a pair of side-by-side elongate openings, one of said gates being operatively associated with each of said openings.

19. A pneumatic outlet as defined in claim 18 wherein each of said cam means effects movement of its respective said gate inwardly toward said centerline as said gate is moved from its closed to its opened position.

20. A pneumatic outlet as defined in claim 19 wherein said pan and said divider have downwardly facing, substantially coplanar surfaces along the bottom margins of said pan and said divider defining the side margins of said elongate opening, said downwardly facing surfaces of said pan and said divider being n sliding engagement with corresponding surfaces on said gate means, with said gate means in its closed position, thereby to substantially seal said elongate opening.

* * * * *